US009207584B2

(12) United States Patent
Izumiya et al.

(10) Patent No.: US 9,207,584 B2
(45) Date of Patent: Dec. 8, 2015

(54) IMAGE FORMING APPARATUS FOR CONTROLLING A STEERING OPERATION OF AN INTERMEDIATE TRANSFER BELT

(71) Applicant: KONICA MINOLTA, INC., Tokyo (JP)

(72) Inventors: Yumiko Izumiya, Hachioji (JP); Satoshi Ogata, Hachioji (JP); Jun Onishi, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/035,575

(22) Filed: Sep. 24, 2013

(65) Prior Publication Data

US 2014/0086596 A1 Mar. 27, 2014

(30) Foreign Application Priority Data

Sep. 26, 2012 (JP) ..... 2012-211712

(51) Int. Cl.
*G03G 15/01* (2006.01)
*G03G 15/16* (2006.01)

(52) U.S. Cl.
CPC .. *G03G 15/1615* (2013.01); *G03G 2215/00156* (2013.01)

(58) Field of Classification Search
CPC ..... G03G 15/1625; G03G 15/755; G03G 2215/00143; G03G 15/1615; G03G 15/0131; G03G 15/0136
USPC ..... 399/121, 302
See application file for complete search history.

(56) References Cited

U.S. PATENT DOCUMENTS 6,219,496 B1 * 4/2001 Kojima et al. ..... 399/43
2013/0071150 A1 * 3/2013 Takagi ..... 399/121

FOREIGN PATENT DOCUMENTS

DE 10317164 A1 * 11/2004
JP 2007-178933 7/2007

OTHER PUBLICATIONS

English abstract of DE 103 17 164 A1.*
Japanese Office Action dated Oct. 28, 2014, issued in counterpart Japanese Application No. 2012-211712.

* cited by examiner

*Primary Examiner* — Walter L Lindsay, Jr.
*Assistant Examiner* — Ruth Labombard
(74) *Attorney, Agent, or Firm* — Holtz, Holtz, Goodman & Chick PC

(57) ABSTRACT

An improved image forming apparatus is described which can inhibit the quality of printed images from being degraded. A control unit performs a steering operation to shift an intermediate transfer belt toward a target belt position by controlling the inclination angle of a steering roller. Also, a memory stores the inclination angle of the steering roller in association with the operational states of rotary members facing the intermediate transfer belt. The control unit updates the values stored in the memory with an update value. When the result of detecting the belt edges indicate that the intermediate transfer belt falls in a predetermined range around the target belt position during the steering operation, the control unit determines the update value on the basis of the steering duration time and the inclination angle of the steering roller.

9 Claims, 5 Drawing Sheets

| PATTERN | 1st TRANSFER | 2nd TRANSFER | BELT POSITION |
|---|---|---|---|
| 1 | pressure contact (color) | pressure contact | ▪ ▪ ▪ ▪ ▪ |
| 2 | pressure contact (color) | disengaged | ▪ ▪ ▪ ▪ ▪ |
| 3 | pressure contact (monochrome) | pressure contact | ▪ ▪ ▪ ▪ ▪ |
| 4 | pressure contact (monochrome) | disengaged | ▪ ▪ ▪ ▪ ▪ |
| 5 | disengaged | pressure contact | ▪ ▪ ▪ ▪ ▪ |
| 6 | disengaged | disengaged | ▪ ▪ ▪ ▪ ▪ |

IMAGE FORMING APPARATUS FOR CONTROLLING A STEERING OPERATION OF AN INTERMEDIATE TRANSFER BELT

CROSS-REFERENCE TO RELATED APPLICATIONS

The present application claims priority under 35 U.S.C. §119 to Japanese Patent Application No. P2012-211712, filed Sep. 26, 2012. The contents of this application are herein incorporated by reference in their entirety.

FIELD OF THE INVENTION

The present invention relates to an image forming apparatus.

DESCRIPTION OF THE RELATED ART

Conventionally, image forming apparatuses such as printers, copying machines and so forth are known as electrophotographic systems. Among them, the so-called tandem color image forming apparatus includes a plurality of photoreceptor drums vertically arranged in contact with one intermediate transfer belt to form full-color images.

This type of image forming apparatus performs a steering operation for correcting the drifting of the intermediate transfer belt for the purpose of inhibiting displacement of the image transferred onto the intermediate transfer belt from each image bearing member. The steering operation is an operation to move the position of the intermediate transfer belt, which is wound around a plurality of rollers including a steering roller, toward a target belt position by controlling the inclination angle of the steering roller.

For example, Japanese Patent Published Application No. 2007-178938 discloses an image forming apparatus which can correct the drifting of an intermediate transfer belt to quickly start printing high quality images while maintaining the durability of the intermediate transfer belt. This image forming apparatus controls the inclination angle of a steering roller to correct the drifting of the intermediate transfer belt by calculating the average position of the belt and calculating the drift amount from which is deducted the fluctuation component arising from variations in the edge profile of the intermediate transfer belt.

Incidentally, an image forming apparatus includes rotary members which are located to face an intermediate transfer belt. Each rotary member has switchable operational states including a pressure contact state in which this rotary member is in contact with the intermediate transfer belt under pressure, and a separate state in which this rotary member is separated from the intermediate transfer belt. The rotary members include photoreceptor drums which are image bearing members to which images are transferred as a first transfer process, and a second transfer roller serving as an image transfer member for transferring the image, which is transferred by the first transfer process, to a sheet as a second transfer process. The intermediate transfer belt of such an image forming apparatus may displace from a correct position when a rotary member switches its operational state. Because of this, even if the steering operation is performed by controlling the inclination angle of the steering roller with respect to the position of the intermediate transfer belt as disclosed in Japanese Patent Published Application No. 2007-178938, the inclination angle may excessively be controlled due to the positional displacement of the intermediate transfer belt, resulting in the problem that the image quality is degraded.

The present invention has been made in order to solve the shortcomings as described above. It is an object of the present invention therefore to inhibit the quality of printed images from being degraded by taking into consideration the switching of the operational states of rotary members in relation to an intermediate transfer belt to perform the steering operation in an appropriate manner.

SUMMARY OF THE INVENTION

To achieve at least one of the abovementioned objects, an image forming apparatus reflecting one aspect of the present invention comprises: an intermediate transfer belt wound around a plurality of rollers including a steering roller; a rotary member having switchable states including a pressure contact state in which this rotary member is in contact with said intermediate transfer belt under pressure, and a separate state in which this rotary member is separated from the intermediate transfer belt; a detecting unit configured to detect the position of said intermediate transfer belt in the width direction; a steering control unit configured to perform a steering operation to shift the position of said intermediate transfer belt toward a target belt position by controlling the inclination angle of said steering roller on the basis of the detection result output from said detecting unit; a storing unit configured to store the inclination angle of said steering roller in association with the operational state of said rotary member; and a processing unit configured to determine an update value of the inclination angle of said steering roller, and perform a updating process to update the inclination angle of said steering roller stored in said storing unit with the update value. In the above configuration, when it is determined on the basis of the detection result output from said detecting unit that the position of said intermediate transfer belt falls in a predetermined range around said target belt position during said steering operation, said processing unit determines the update value on the basis of the duration for which said steering operation has been performed and the inclination angle of said steering roller controlled by said steering control unit.

In a preferred embodiment, when switching the operational state of said rotary member, said processing unit performs said updating process of updating the inclination angle of said steering roller stored in association with the operational state of said rotary member before switching.

Also, in a preferred embodiment, said rotary member comprises: an image bearing member configured to bear an image and transfer this image to said intermediate transfer belt as a first transfer process; and an image transfer member configured to transfer the image from said intermediate transfer belt to a sheet as a second transfer process, wherein said storing unit stores the inclination angle of said steering roller in association with a combination of the operational state of said image bearing member, which is said rotary member, in relation to said intermediate transfer belt and the operational state of said image transfer member, which is said rotary member, in relation to said intermediate transfer belt.

Furthermore, in a preferred embodiment, before switching the operational state of said rotary member, said steering control unit controls said steering roller at the inclination angle of said steering roller which has been stored in said storing unit in association with the operational state of said rotary members after switching.

Furthermore, in a preferred embodiment, said storing unit is a nonvolatile memory.

Furthermore, a preferred embodiment further comprises an intermediate transfer unit including said intermediate transfer belt, wherein when it is determined that said intermediate transfer unit is replaced, said processing unit resets the inclination angle of said steering roller stored in said storing unit to the initial value.

Furthermore, in a preferred embodiment, said processing unit determines, by referring to an IC tag attached to said intermediate transfer unit, that said intermediate transfer unit is replaced.

Furthermore, in a preferred embodiment, said processing unit is provided with a mode in which, when it is determined that said intermediate transfer unit is replaced, the updating process is automatically performed after setting the operational state of said rotary member in a predetermined state.

Furthermore, in a preferred embodiment, said processing unit is provided with a mode in which the updating process is automatically performed after setting the operational state of said rotary member in a predetermined state.

DETAILED DESCRIPTION OF THE PREFERRED EMBODIMENT

First Embodiment

Figure 1:
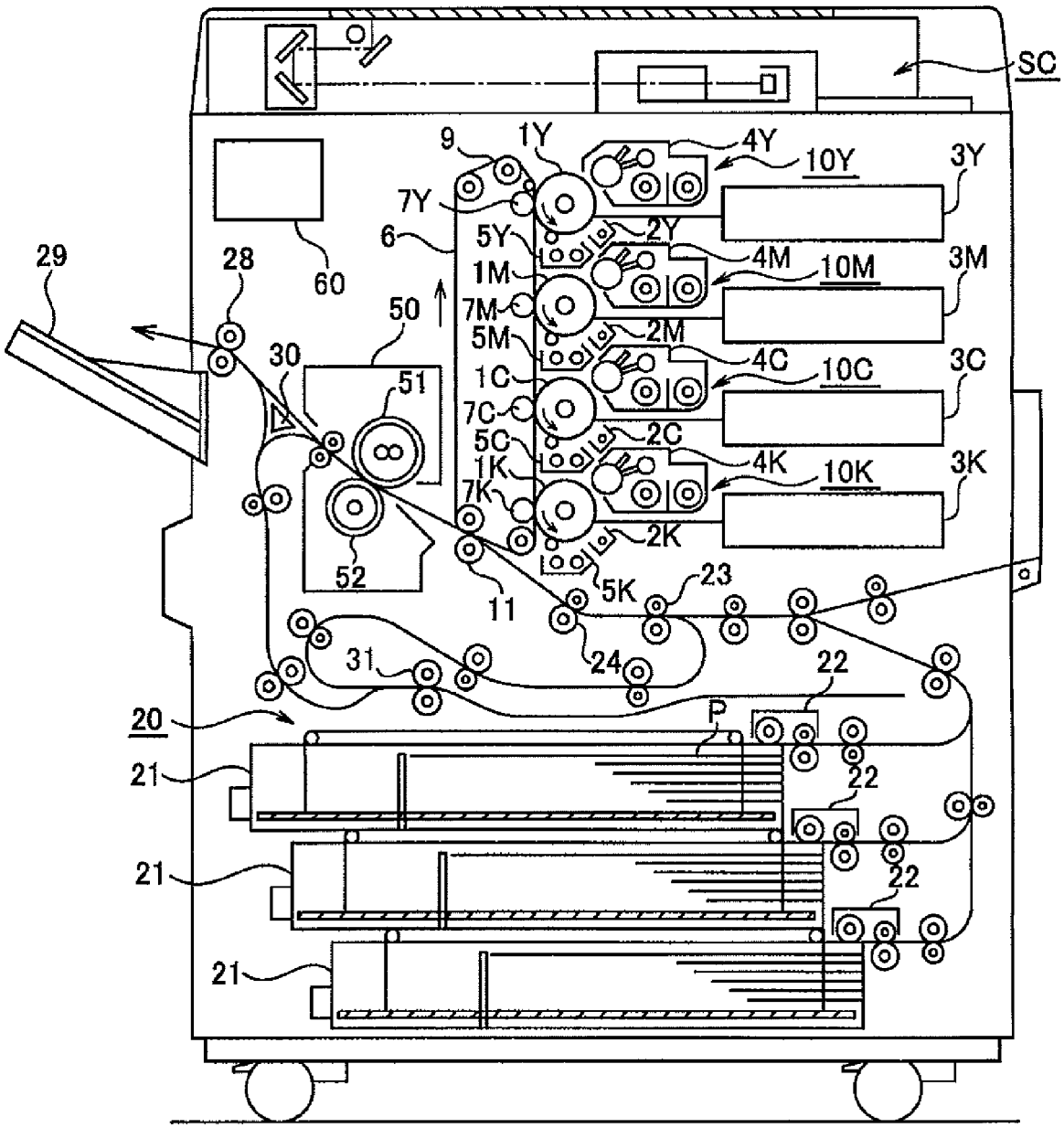
FIG. 1 is a view for schematically showing the configuration of an image forming apparatus.

FIG. 1 is a view for schematically showing the configuration of an image forming apparatus according to the present embodiment. This image forming apparatus is a copying machine which is an electrophotographic image forming apparatus called a tandem color image forming apparatus. The tandem color image forming apparatus includes a plurality of photoreceptor drums vertically arranged in contact with one intermediate transfer belt to form full-color images.

The image forming apparatus consists mainly of an original reading unit SC, four image forming units 10Y, 10M, 10C and 10K, a fixing unit 50 and a control unit 60 which are installed within one housing.

The original reading unit SC scans and exposes the image of an original with an optical system of a scanning/exposing device, and reads the reflected light therefrom with a line image sensor to obtain image signals. The image signals are processed by performing A/D conversion, shading compensation, data compression and so on, and input to a control unit 60 as image data. Incidentally, the image data input to the control unit 60 is not limited to the image data as captured by the original reading unit SC, but can be the data for example as received from another image forming apparatus, a personal computer or the like connected to the image forming apparatus.

The four image forming units 10Y, 10M, 10C and 10K are an image forming unit 10Y for forming a yellow (Y) image, an image forming unit 10M for forming a magenta (M) image, an image forming unit 10C for forming a cyan (C) image, and an image forming unit 10K for forming a black (K) image.

The image forming unit 10Y is provided with a photoreceptor drum 1Y, and a charging unit 2Y, an optical writing unit 3Y, a development apparatus 4Y and a drum cleaner 5Y which are arranged around the photoreceptor drum 1Y. Likewise, the other image forming units 10M, 10C and 10K are provided with photoreceptor drums 1M, 1C and 1K, and charging units 2M, 2C and 2K, optical writing units 3M, 3C and 3K, development apparatuses 4M, 4C and 4K, drum cleaners 5M, 5C and 5K which are arranged around the image forming units 10M, 10C and 10K respectively.

The surfaces of the photoreceptor drums 1Y, 1M, 1C and 1K are uniformly charged with electricity by the charging units 2Y, 2M, 2C and 2K, and the optical writing units 3Y, 3M, 3C and 3K perform a scanning exposure process to form latent images on the photoreceptor drums 1Y, 1M, 1C and 1K. The development apparatuses 4Y, 4M, 4C and 4K then make visible the latent images on the photoreceptor drums 1Y, 1M, 1C and 1K by developing the images with toners. Monochromatic images (toner images) are thereby formed on the photoreceptor drums 1Y, 1M, 1C and 1K respectively corresponding to predetermined color components, i.e., yellow, magenta, cyan and black. The monochromatic images formed on the photoreceptor drums 1Y, 1M, 1C and 1K are transferred to a predetermined location of an intermediate transfer belt 6 which is a belt-like rotary member through first transfer rollers 7Y, 7M, 7C and 7K. In connection with the present embodiment, the photoreceptor drums 1Y, 1M, 1C and 1K are rotary members serving as image bearing members which bear images to be transferred to the intermediate transfer belt 6 respectively in correspondence with the predetermined color components.

Figure 2:
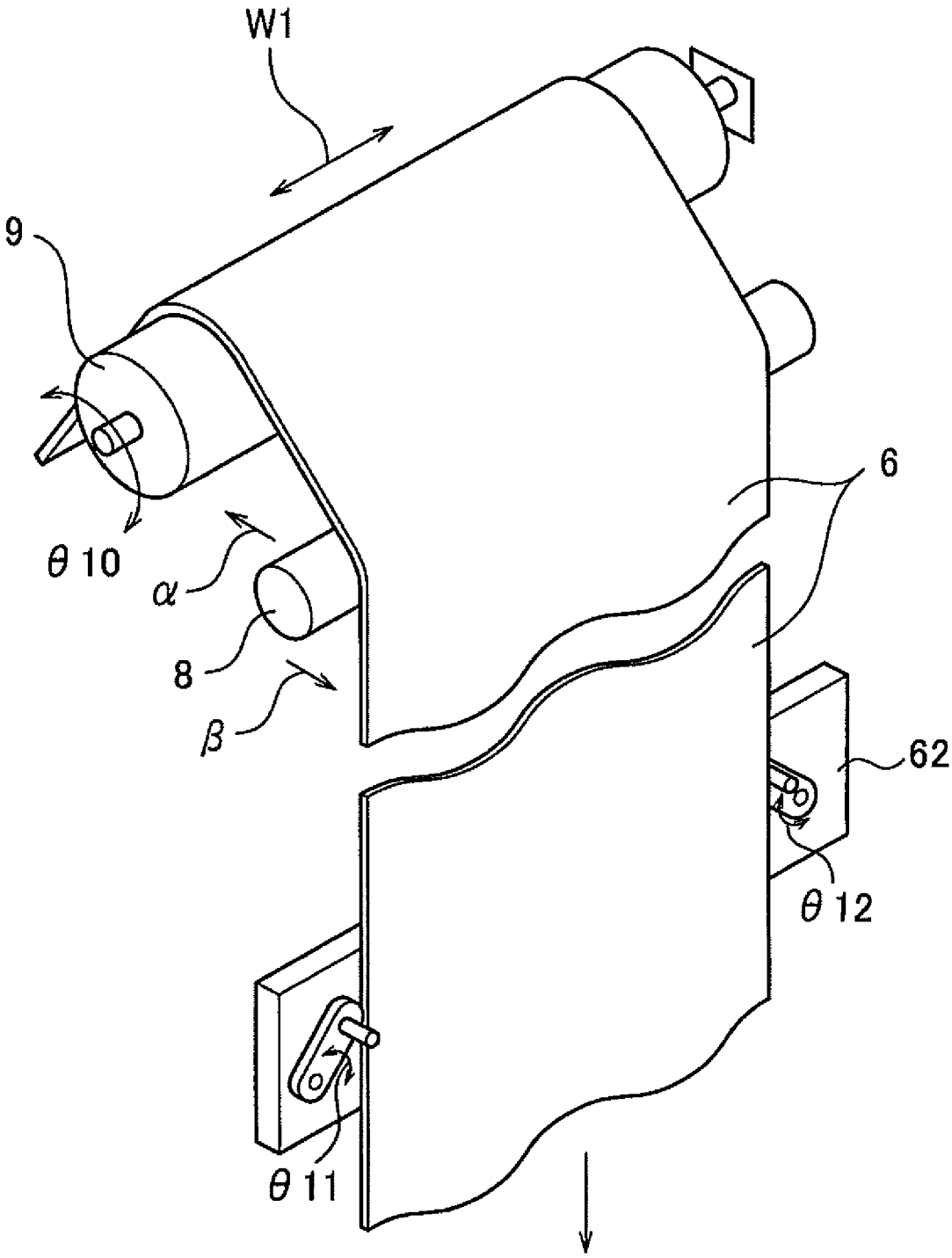
FIG. 2 is a perspective view for schematically showing the main structure of the image forming apparatus around an intermediate transfer belt.

FIG. 2 is a perspective view for schematically showing the main structure of the image forming apparatus around the intermediate transfer belt 6. The intermediate transfer belt 6 is wound around a pressure contact roller 8, a steering roller 9 and other rollers (not shown in the figure).

Figures 3, 4:
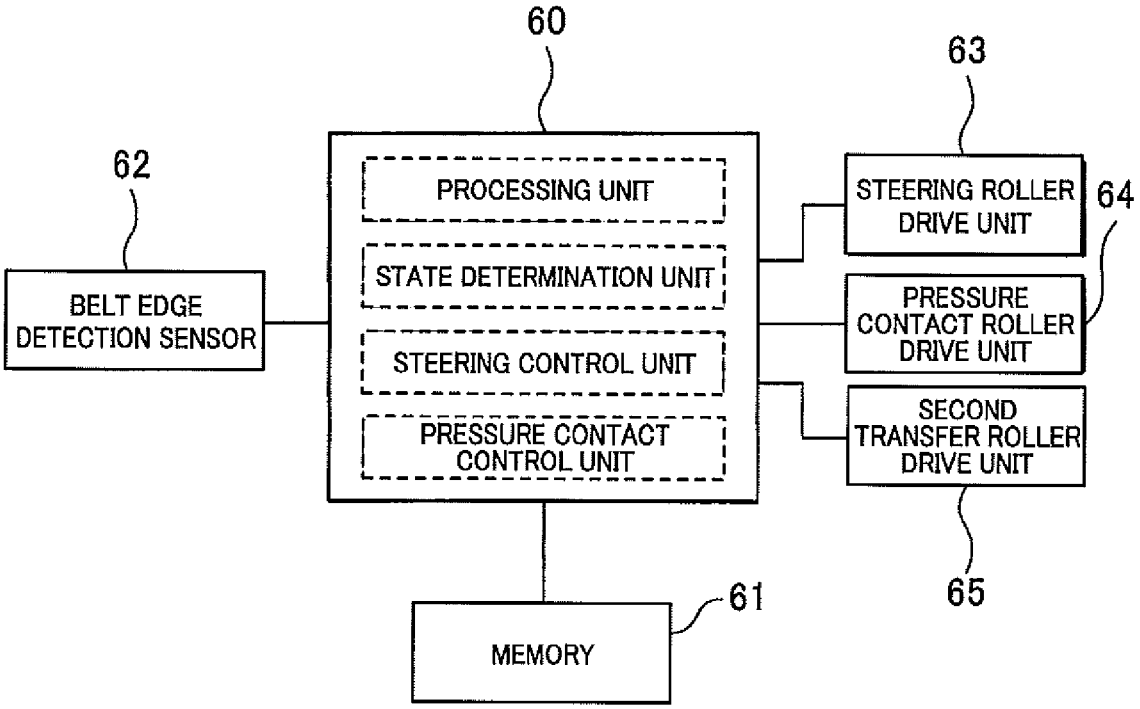
FIG. 3 is a block diagram for functionally showing the structure of the control architecture of an image forming apparatus.
FIG. 4 is a table for explaining a plurality of state patterns and the inclination angle of the steering roller associated with each state pattern and stored in a memory.

The pressure contact roller 8 is connected to a pressure contact roller drive unit 64 (refer to FIG. 3). Also, the pressure contact roller drive unit 64 can switch the pressure contact roller 8 between a pressure contact state in which this pressure contact roller 8 makes the intermediate transfer belt 6 get in contact with the photoreceptor drums 1Y, 1M, 1C and 1K, and a separate state in which this pressure contact roller 8 makes the intermediate transfer belt 6 get away from the photoreceptor drums 1Y, 1M, 1C and 1K. Specifically, in the pressure contact state as described above, the pressure contact roller 8 is set up in a predetermined pressure contact position. The pressure contact roller 8 is retracted from the pressure contact position to the separate position in a direction $\alpha$ to switch the intermediate transfer belt 6 from a pressure contact state to a separate state. Conversely, the pressure contact roller 8 is forwarded from the separate position to the pressure contact position in a direction $\beta$ to switch the intermediate transfer belt 6 from the separate state to the pressure contact state. When forming an image, the pressure contact roller 8 is set in the pressure contact position so that images can be transferred from the photoreceptor drums 1Y, 1M, 1C and 1K to the intermediate transfer belt 6.

The steering roller 9 is supported by a support member at one end and connected to a steering roller drive unit 63 (refer to FIG. 3) at the other end. The steering roller drive unit 63 moves the other end of the steering roller 9 to form a circle about the one end as a fulcrum (in the turning direction θ10). The intermediate transfer belt 6 can be shifted in the width direction W1 (the direction perpendicular to the running direction of the intermediate transfer belt 6) by moving the other end of the steering roller 9 to adjust the inclination angle of the steering roller 9.

For example, when inclining the steering roller 9 to one side along the turning direction θ10, the intermediate transfer belt 6 is shifted inwards (i.e., toward the one end of the steering roller 9). Conversely, when inclining the steering roller 9 to the other side along the turning direction θ10, the intermediate transfer belt 6 is shifted outwards (i.e., toward the other end of the steering roller 9). The inclination angle of the steering roller 9 is controlled by the control unit 60 as a steering operation to be described below.

Referring to FIG. 1 again, the images transferred to the intermediate transfer belt 6 corresponding to the predetermined color components are next transferred by an image transfer member to a sheet P which is conveyed with a predetermined timing by a paper conveying unit 20 to be described below. The image transfer member consists for example of a second transfer roller 11 which is a rotary member in the form of a roller.

The second transfer roller 11 is connected to a second transfer roller drive unit 65 (refer to FIG. 3) for switching the position of the second transfer roller 11. The second transfer roller drive unit 65 drives the second transfer roller 11 to switch between a pressure contact state in which the second transfer roller 11 is in pressure contact with the intermediate transfer belt 6, and a separate state in which the second transfer roller 11 is separated (disengaged) from the intermediate transfer belt 6. When forming an image, the second transfer roller 11 is set in the pressure contact state such that the image on the intermediate transfer belt 6 is secondly transferred to a sheet P by passing the sheet P through a nip portion (hereinafter referred to as "second transfer nip portion") between the intermediate transfer belt 6 and the second transfer roller 11.

The paper conveying unit 20 conveys a sheet P along a conveying route. Sheets P are stored in paper feed trays 21, extracted from the paper feed tray 21 by paper feed units 22 and transferred to the conveying route.

A plurality of conveyance units for conveying sheets P are provided in the upstream side of the second transfer nip portion on this conveying route. Each conveyance unit consists of a pair of rollers which are urged against each other. At least one of the pair of rollers is rotated by a drive mechanism consisting mainly of an electric motor. A sheet P is conveyed by rotating the conveyance unit which holds the sheet P between the pair of rollers, and transferred to the second transfer nip with a predetermined timing. In accordance with the present embodiment, there are a plurality of intermediate conveyance rollers, a loop roller 23 and a paper stop roller 24 respectively as conveyance units on the conveying route to the second transfer roller. Meanwhile, a conveyance unit can be made not only of a pair of rollers, but also of a combination of a pair of belts, a combination of a belt and a roller, or any other combination of a pair of rotary members.

The fixing unit 50 is a device which performs a fixing process for fixing an image to a sheet P conveyed from the second transfer nip portion. The fixing unit 50 consists for example of fixing rollers 51 and 52 which are a pair of fixing members urged against each other, and a heater for heating one or both of the fixing rollers 51 and 52. This fixing unit 50 fixes an image to a sheet P in a fixing process during conveying the sheet P under the pressure applied at the nip portion with the heat applied through the fixing rollers 51 and 52.

The sheet P with the image fixed by the fixing unit 50 is discharged by a discharging roller 28 to a catch tray 29 attached to the external side of the housing. Also, when an image is to be formed also on the back side of a sheet P, the sheet P with the image formed on the front side is conveyed to reversing rollers 31 located below by a switch gate 30. After holding the tail end of the sheet P which is conveyed, the reversing rollers 31 reverse the conveyance direction of the sheet P to reverse the sides of the sheet P, followed by directing the sheet P to a refeed conveying route. The sheet P conveyed to this refeed conveying route is conveyed by a plurality of conveyance units for refeeding and returned to the transfer site.

The control unit 60 is responsible for integrally controlling the image forming apparatus and can be implemented with a microcomputer mainly including a CPU, a ROM, a RAM, and an I/O interface.

The control unit 60 forms an image on a sheet P by controlling the units of the image forming apparatus (for example, the image forming units 10Y, 10M, 10C and 10K, the paper conveying unit 20, the fixing unit 50 and so forth) to perform the following operations, i.e., (1) charging the photoreceptor drums 1Y, 1M, 1C and 1K, (2) forming electrostatic latent images on the photoreceptor drums 1Y, 1M, 1C and 1K with the optical writing units 3Y, 3M, 3C and 3K, (3) making toners adhere to the electrostatic latent images which is formed, (4) transferring the electrostatic latent images from the photoreceptor drums 1Y, 1M, 1C and 1K to the intermediate transfer belt 6 as a first transfer process, (5) conveying a sheet P by the paper conveying unit 20, (6) transferring the toner image from the intermediate transfer belt 6 to the sheet P as a second transfer process, and (7) fixing the toner image to the sheet P by the fixing unit 50.

FIG. 3 is a block diagram for functionally showing the structure of the control architecture of an image forming apparatus according to the present embodiment. The control unit 60 (as a pressure contact control unit) of the present embodiment changes the state of the intermediate transfer belt 6 to switch its operational state in relation to the photoreceptor drums 1Y, 1M, 1C and 1K between the pressure contact state and the separate state by controlling the pressure contact roller drive unit 64 which drives the pressure contact roller 8 to change the position thereof. Furthermore, the control unit 60 (as a pressure contact control unit) changes the state of the second transfer roller 11 to switch its operational state in relation to the intermediate transfer belt 6 between the pressure contact state and the separate state by controlling the second transfer roller drive unit 65 which drives the second transfer roller 11 to change the position thereof. This switching of the operational state is performed in accordance with a predetermined pattern corresponding to the progress of image formation.

In addition to this, the control unit 60 (as a steering control unit) performs the steering operation to shift the position of the intermediate transfer belt 6 toward a target belt position by controlling the steering roller drive unit 63 which moves the other end of the steering roller 9. This steering operation is performed while the intermediate transfer belt 6 is rotating. Incidentally, when switching the operational states of the rotary members (i.e., the photoreceptor drums 1Y, 1M, 1C and 1K and the second transfer roller 11 in the case of the present embodiment) in relation to the intermediate transfer belt 6, the control unit 60 controls the inclination angle of the steering roller 9 to a set value just before the operational states are switched. This set value has been stored in a memory 61 as the inclination angle in association with the operational states of the rotary members after switching.

Furthermore, the control unit 60 (as a processing unit) determines an update value of the inclination angle of the steering roller 9, and performs an updating process of updating the previous set value stored in the memory 61 with the update value. In this case, when it is determined that the position of the intermediate transfer belt 6 falls in a predetermined range around the target belt position during the steering operation, the control unit 60 determines the update value on the basis of the duration for which the steering operation has been performed and the inclination angle of the steering roller 9 which is controlled.

The control unit 60 (as a state determination unit) also determines whether the operational states of the photoreceptor drums 1Y, 1M, 1C and 1K in relation to the intermediate transfer belt 6 are the pressure contact states or the disengaged states, and whether the operational state of the second transfer roller 11 in relation to the intermediate transfer belt 6 are the pressure contact states or the disengaged states.

The memory 61 is a storing unit for storing the set values of the inclination angle of the steering roller 9 in association with a plurality of state patterns respectively as shown in a table of FIG. 4. The memory 61 may be implemented with a nonvolatile memory such as an EEPROM. Each of the state patterns in the table represents a combination of the operational states in the first transfer site and the operational states in the second transfer site, i.e., combinations of the operational states (the pressure contact states or the disengaged states) of the photoreceptor drums 1Y, 1M, 1C and 1K in relation to the intermediate transfer belt 6 and the operational state (the pressure contact state or the disengaged state) of the second transfer roller 11 in relation to the intermediate transfer belt 6. In the case of the present embodiment, six state patterns are provided by distinguishing, in the first transfer site, the pressure contact states for color printing and the pressure contact states for black-and-white printing.

The control unit 60 receives a detection signal from a belt edge detection sensor 62 for performing the above control. As illustrated in FIG. 2, the belt edge detection sensor 62 is a sensor which is fixed in the vicinity of the intermediate transfer belt 6 and capable of detecting the position of the intermediate transfer belt 30 in the width direction W1. The belt edge detection sensor 62 is provided with two levers 62*a* and 62*b* which detect the opposite edges of the intermediate transfer belt 6 respectively. The position of the opposite edges of the intermediate transfer belt 6 correspond to the angular positions θ11 and θ12 of the levers 62*a* and 62*b* respectively.

Figure 5:
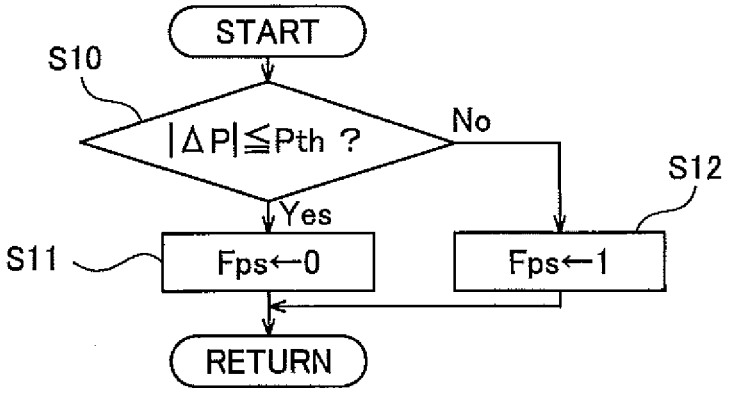
FIG. 5 is a flow chart for showing a series of steps of controlling the image forming apparatus in accordance with a first embodiment of the present invention.

FIG. 5 is a flow chart for showing a series of steps of controlling the image forming apparatus in accordance with the present embodiment. The process shown in this flow chart is a process for determining and saving the update value of the inclination angle of the steering roller 9, and periodically performed by the control unit 60 in a predetermined cycle.

First, in step 10 (S10), the control unit 60 determines whether or not the deviation ΔP of the intermediate transfer belt 6 is smaller than or equal to a predetermined reference value Pth. The deviation ΔP is the absolute value of the difference between the target belt position indicative of the target position of the intermediate transfer belt 6 and the position of the intermediate transfer belt 6 determined on the basis of the detection results output from the belt edge detection sensor 62. On the other hand, the reference value Pth is a threshold value with which it is judged whether or not the intermediate transfer belt 6 is sufficiently close to the target belt position, and has been determined on the basis of experiments and simulation in advance.

If the determination is in the affirmative in step 10, i.e., if the deviation ΔP is smaller than or equal to the reference value Pth, the process proceeds to step 11 (S11). Conversely, if the determination is in the negative in step 10, i.e., if the deviation ΔP is larger than the reference value Pth, the process proceeds to step 12 (S12). However, the affirmative determination in step 10 is made only when the deviation ΔP is continuously smaller than or equal to the reference value Pth for a predetermined period. Namely, it is determined in step 10 whether or not the position of the intermediate transfer belt 6 falls in the predetermined range around the target belt position.

In step 11, the control unit 60 sets a flag Fps to "0" which indicates that the position of the intermediate transfer belt 6 falls of the predetermined range around the target belt position. On the other hand, in step 12, the control unit 60 sets the flag Fps to "1" which indicates that the position of the intermediate transfer belt 6 falls out in the predetermined range. In the case where the deviation ΔP has converged within the predetermined range and it is determined that the intermediate transfer belt 6 is drifting only in a small fluctuation range, the process (S21 to S28) shown in FIG. 6 is performed.

Figure 6:
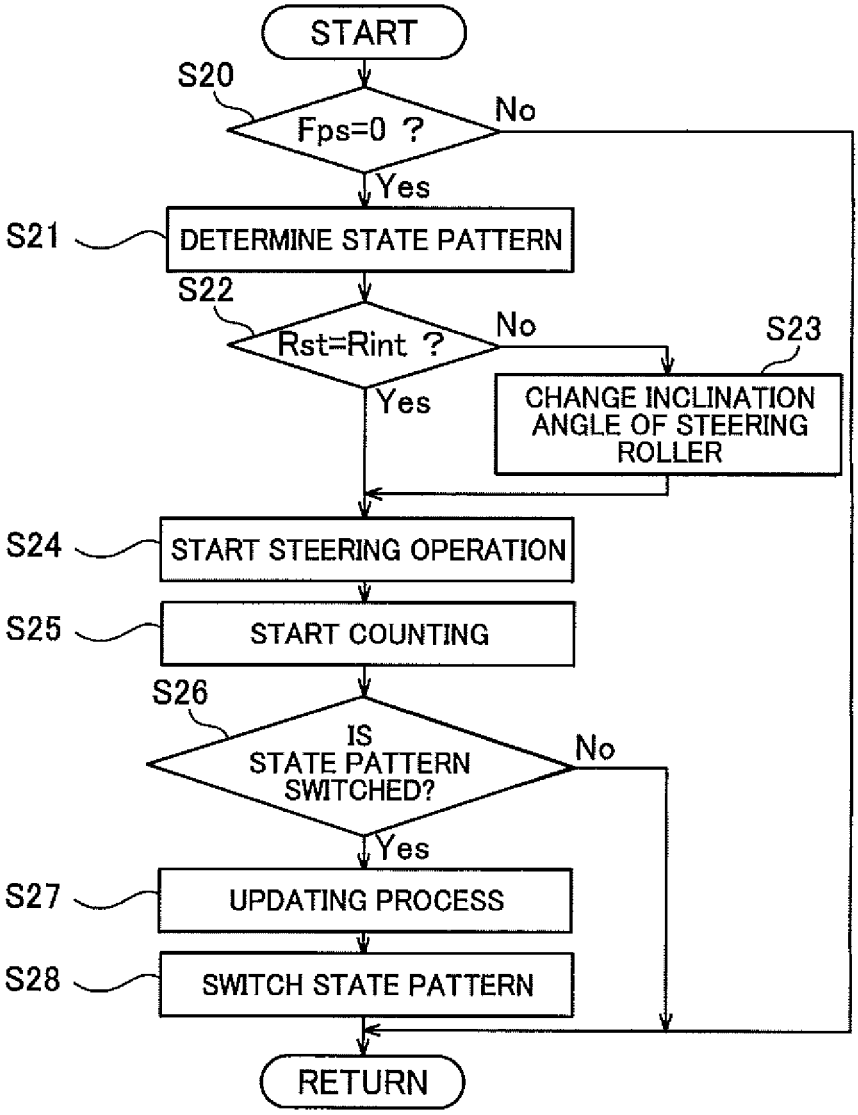
FIG. 6 is a flow chart for showing a series of steps of controlling the image forming apparatus in accordance with the first embodiment.

FIG. 6 is a flow chart for showing a series of steps of controlling the image forming apparatus in accordance with the present embodiment. The process shown in this flow chart is a process for determining and saving the update value of the inclination angle of the steering roller 9, and periodically performed by the control unit 60 in a predetermined cycle.

In step 20 (S20), the control unit 60 determines whether or not the flag Fps is set to "0". If the determination is in the affirmative in step 20, i.e., if the flag Fps is set to "0", the process proceeds to step 21 (S21). Conversely, if the determination is in the negative in step 20, i.e., if the flag Fps is set to "1", this routine returns the control.

In step 21, the control unit 60 determines the state pattern, i.e., whether the operational states of the photoreceptor drums 1Y, 1M, 1C and 1K in relation to the intermediate transfer belt 6 are the pressure contact states or the disengaged states, and whether the operational state of the second transfer roller 11 in relation to the intermediate transfer belt 6 are the pressure contact states or the disengaged states. Furthermore, if the operational states of the photoreceptor drums 1Y, 1M, 1C and 1K are the pressure contact states, the control unit 60 determines whether the operational states in the first transfer site are the pressure contact states for color printing or the pressure contact states for black-and-white printing.

In step 22 (S22), the control unit 60 evaluates a value (Rst) which is one of the set values of the inclination angle of the steering roller 9 stored in the memory 61 corresponding to the state pattern evaluated in step 21, and determines whether or not the set value (Rst) is an initial value (Rint). The set value (Rst) stored in the memory 61 is initialized to an initial value of the inclination angle of the steering roller 9 at start-up. Namely, in this step 22, the control unit 60 reads the set value (Rst) of the inclination angle of the steering roller 9 from the memory 61 in correspondence with the state pattern determined in step 21, and determines whether or not this value equals the initial value (Rint) which is stored in the ROM.

If the determination is in the affirmative in step 22, i.e., the inclination angle (Rst) of the steering roller 9 is the initial value (Rint), the process proceeds to step 24 (S24). Conversely, if the determination is in the negative in step 22, i.e., the inclination angle (Rst) of the steering roller 9 is not the initial value (Rint), the process proceeds to step 23 (S23).

In step 23, the control unit 60 accesses the memory 61, and reads therefrom the inclination angle of the steering roller 9 corresponding to the state pattern evaluated in step 21. The control unit 60 then adjusts the inclination angle of the steering roller 9 to the set value (Rst) read from the memory 61 by controlling the steering roller drive unit 63.

In step 24, the control unit 60 starts the steering operation. When the steering operation has been started and continued, the control unit 60 continues the steering operation as it is in step 24.

In step 25 (S25), the control unit 60 starts counting with a timer.

In step 26 (S26), the control unit 60 determines whether or not the state pattern is to be switched. The state pattern is switched in accordance with the progress of image formation. When the state pattern is to be switched, an interrupt request is issued. The control unit 60 can therefore determine whether or not the state pattern is about to be switched with reference to the interrupt request signal. If the determination is in the affirmative in step 26, i.e. if the state pattern is to be switched, the process proceeds to step 27. Conversely, if the determination is in the negative in step 26, i.e. if the state pattern is not to be switched, this routine returns the control.

In step 27, the control unit 60 determines the update value of the inclination angle of the steering roller 9, and performs the updating process of updating the previous set value stored in the memory 61 (the inclination angle of the steering roller 9 associated with the state pattern before switching) with the update value. Specifically, the control unit 60 determines the update value of the inclination angle of the steering roller 9 on the basis of the current inclination angle of the steering roller 9 and the counter value of the timer, i.e., the duration for which the steering operation has been performed. Since the steering operation is an operation to correct the position of the intermediate transfer belt 6 toward the target belt position, as the steering operation is performed for a longer duration, the intermediate transfer belt 6 is located closer to the target belt position, and the positional variation (drifting amount) thereof in the width direction W1 becomes smaller. Namely, as the duration for which the steering operation has been performed becomes longer, the position of the intermediate transfer belt 6 is considered likely to be located in the target belt position or stabilized around the target belt position only with a small controlling amount.

The control unit 60 thereby determines the update value of the inclination angle of the steering roller 9 by comparing the counter value of the timer with a predetermined upper reference time and a predetermined lower reference time (the upper reference time>the lower reference time) as follows.

First, if the counter value of the timer exceeds the upper reference time for determining that the duration of the steering operation is sufficiently long, the control unit 60 sets the update value to the current inclination angle of the steering roller 9. Conversely, if the counter value of the timer does not exceed the upper reference time but do exceed the lower reference time for determining that the steering operation is continued for a certain period, the control unit 60 sets the update value to the current inclination angle of the steering roller 9 multiplied by an adjustment factor. The adjustment factor is a factor introduced to make the adjustment amount of the steering operation decrease as the counter value of the timer increases near the upper reference time, from the view point that as the closer the counter value is to the upper reference time, the closer the current inclination angle of the steering roller 9 is to the correct value. On the other hand, if the counter value of the timer does not exceed the lower reference time, the control unit 60 sets the update value to the current set value stored in the memory 61.

In step 28 (S28), the control unit 60 switches the state pattern by controlling one or both of the pressure contact roller drive unit 64 and the second transfer roller drive unit 65.

In accordance with the present embodiment as has been discussed above, the control unit 60 performs the steering operation to shift the position of the intermediate transfer belt 6 toward the target belt position by controlling the inclination angle of the steering roller 9 on the basis of the detection result output from the belt edge detection sensor 62. Also, the memory 61 stores, as set values, the inclination angle of the steering roller 9 in association with the operational states of the rotary members which are located to face the intermediate transfer belt 6. The control unit 60 determines the update value of the inclination angle of the steering roller 9, and performs the updating process of updating the set value stored in the memory 61 with the update value. In this case, when it is determined from the detection result output from the belt edge detection sensor 62 that the position of the intermediate transfer belt 6 falls in the predetermined range around the target belt position during the steering operation, the control unit 60 determines the update value on the basis of the duration for which the steering operation has been performed and the inclination angle of the steering roller 9 which is controlled.

By this configuration, it is possible to store the inclination angle of the steering roller 9 which stabilizes the position of the intermediate transfer belt 6 in the memory 61 after continuing the steering operation. The inclination angle of the steering roller can thereby be controlled not only on the basis of the location information of the current intermediate transfer belt 6 but also with reference to the set value stored in this memory 61. This makes it possible to perform the steering operation in an appropriate manner irrespective of the switching of the operational states of the rotary members in relation to the intermediate transfer belt 6, and thereby inhibit the image quality from being degraded.

Also, in the case of the present embodiment, when switching the operational states of the rotary members, the control unit 60 performs the updating process of updating the set value of the inclination angle of the steering roller 9 stored in association with the operational states of the rotary members before switching.

By this configuration, in response to the switching of the operational states as a cause of drifting the intermediate transfer belt 6, an appropriate set value of the inclination angle of the steering roller 9 can be stored in the memory 61 in association with each combination of the operational states.

Furthermore, in the case of the present embodiment, the rotary members include the photoreceptor drums 1Y, 1M, 1C and 1K and the second transfer roller 11, and the operational states of the rotary members are combined as the combination of the operational states of the photoreceptor drums 1Y, 1M, 1C and 1K in relation to the intermediate transfer belt 6 and the operational state of the second transfer roller 11 in relation to the intermediate transfer belt 6.

By this configuration, in response to the switching of the operational states as a cause of drifting the intermediate transfer belt 6, an appropriate set value of the inclination angle of the steering roller 9 can be stored in the memory 61 in association with each combination of the operational states.

In the case of the present embodiment, before switching the operational states of the rotary members, the control unit 60 controls the steering roller 9 at the set value of the inclination angle of the steering roller 9 which has been stored in the memory 61 in association with the operational states of the rotary members after switching.

By this configuration, the inclination angle of the steering roller 9 is controlled in accordance with the set values stored in the memory 61. It is thereby possible to inhibit the inclination angle of the steering roller 9 from being excessively controlled even if the intermediate transfer belt 6 drifts due to the switching of the operational states of the rotary members, and inhibit the image quality from being degraded.

The memory 61 of the present embodiment is a nonvolatile memory.

The data stored in the memory 61 can thereby be maintained even after powering off the image forming apparatus. By this configuration, it is avoided that the data stored in the memory 61 is initialized every time the system is powered on.

Second Embodiment

Figure 7:
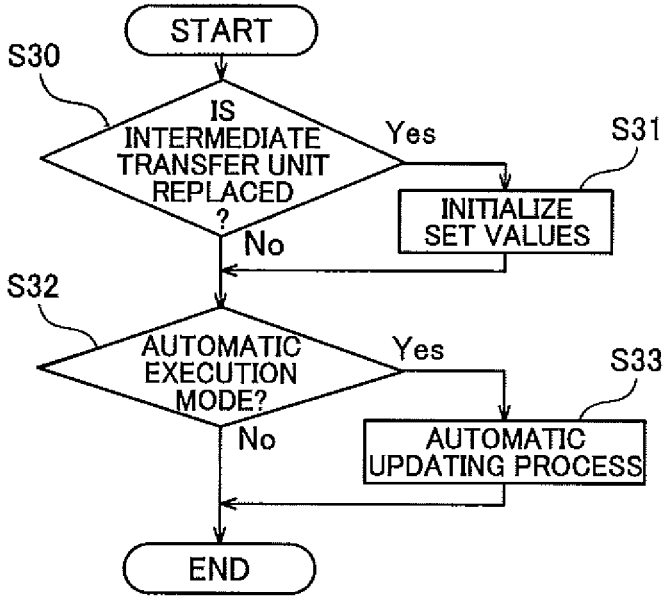
FIG. 7 is a flow chart for showing a series of steps of controlling the image forming apparatus in accordance with a second embodiment of the present invention.

FIG. 7 is a flow chart for showing a series of steps of controlling the image forming apparatus in accordance with the present embodiment. The procedure shown in this flow chart is called or triggered when the image forming apparatus is powered on, and performed by the control unit 60.

First, in step 30, the control unit 60 determines whether or not an intermediate transfer unit is replaced. The intermediate transfer unit of the image forming apparatus is provided as a replaceable unit including the intermediate transfer belt 6, the rollers wound around this intermediate transfer belt 6 and the like, from the view point of maintenance. In this step 30, it is determined whether or not the intermediate transfer unit is replaced. For example, in the case where the intermediate transfer unit is provided with an IC (Integrated Circuit) tag for identifying an individual product, the control unit 60 can read the IC tag with a reader which is not shown in the figure, and make the determination in step 30 on the basis of the identifier of the intermediate transfer unit contained in the information transmitted from the IC tag.

Alternatively, the determination in step 30 can be made in accordance with an input operation by a user through a manipulation unit or the like to indicate that the intermediate transfer unit is replaced. Furthermore, the counter value of the timer may be used for making the determination in step 30. Meanwhile, in this step, it may be determined whether or not a component of the intermediate transfer unit or any other component which may affect the intermediate transfer belt 6 is replaced, rather than whether or not the intermediate transfer unit is replaced as a whole.

If the determination is in the affirmative in step 30, i.e., if the intermediate transfer unit is replaced, the process proceeds to step 31 (S31). Conversely, if the determination is in the negative in step 30, i.e., if the intermediate transfer unit is not replaced, the process proceeds to step 32 (S32).

In step 31, the control unit 60 initializes the information (set values) about the inclination angle of the steering roller 9 stored in the memory 61. Specifically, the control unit 60 updates the set values of the inclination angle of the steering roller 9 with each of initial values stored in the ROM.

In step 32, the control unit 60 determines whether or not an automatic execution mode is set on the image forming apparatus. In this automatic execution mode, the control unit 60 sets the operational states to a predetermined state pattern and automatically perform the updating process as described above for the purpose of obtaining the optimal set value of the inclination angle of the steering roller 9 to be stored in the memory 61. The determination in step 32 can be made by referring to a setting option of whether or not to shift into the automatic execution mode with a desired timing, for example, at start-up or after replacing the intermediate transfer unit, Incidentally, this setting option can be preset before shipping or selected by a user at any desired time.

If the determination is in the affirmative in step 32, i.e., if the automatic execution mode is set on, the process proceeds to step 33 (S33). Conversely, if the determination is in the negative in step 32, i.e., if the automatic execution mode is not set on, this routine returns control.

Figure 8:
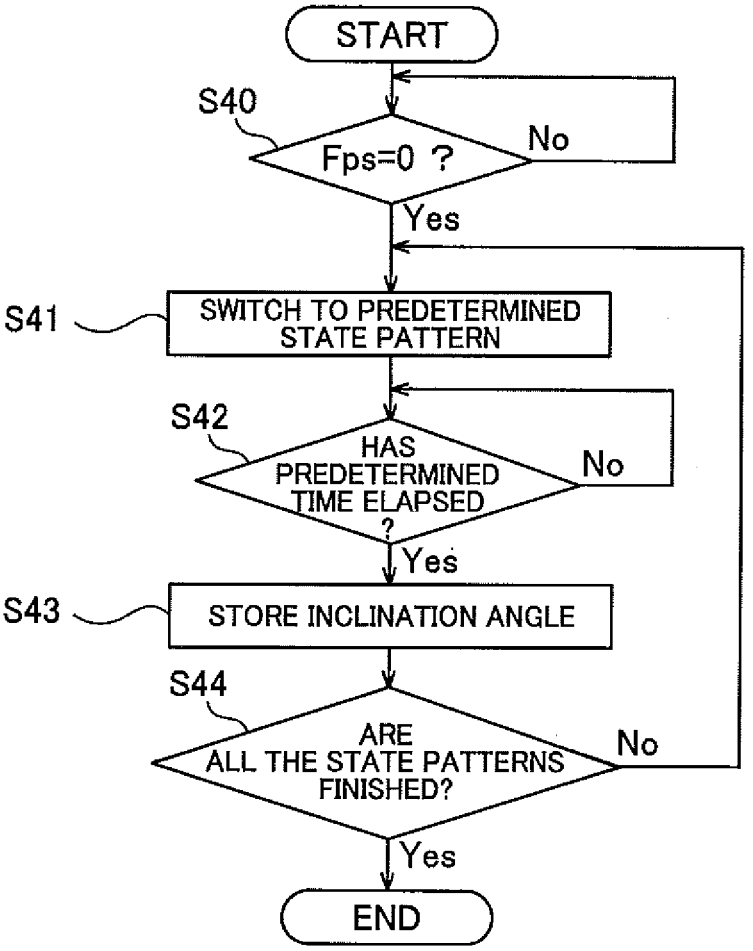
FIG. 8 is a flow chart for showing the details of an updating process which is automatically performed in step 33 of FIG. 7

In step 33, the control unit 60 automatically performs the updating process. FIG. 8 is a flow chart for showing the details of the updating process which is automatically performed in step 33. When performing this automatic updating process, the control unit 60 has performed the process of setting the Fps as shown in FIG. 5 and started the steering operation.

First, in step 40 (S40), the control unit 60 determines whether or not the flag Fps is set to "0". If the determination is in the affirmative in step 40, i.e., if the flag Fps is set to "0", the process proceeds to step 41 (S41). Conversely, if the determination is in the negative in step 40, i.e., if the flag Fps is set to "1", step 40 is repeated.

In step 41, the control unit 60 sets up the operational states in a predetermined state pattern in regard to which the updating process is to be performed. The automatic updating process is performed for the state pattern(s) whose set value stored in the memory 61 is not changed from the initial value, the state pattern(s) whose set value is not changed for a long time, and the state pattern(s) which is designated by a user. Incidentally, in the case where there are a plurality of state patterns for which the automatic updating process is to be performed, one of the state patterns is arbitrarily selected in step 41.

In step 42 (S42), the control unit 60 determines whether or not a predetermined time has elapsed. This predetermined time is set to, for example, the predetermined upper reference time as explained above in conjunction with the first embodiment, or any other appropriate reference time as long as this reference time can be used to determine if the steering operation is sufficiently performed.

In step 43 (S43), the control unit 60 obtains the current inclination angle of the steering roller 9, and stores this inclination angle in the memory 61 as the set value in association with the current state pattern.

In step 44, the control unit 60 determines whether or not the process of storing the inclination angle is finished in association with every state pattern for which the automatic updating process is to be performed. If the determination is in the affirmative in step 44, i.e., the process of storing the inclination angle is finished in association with every state pattern, this routine returns control. Conversely, if the determination is in the negative in step 44, i.e., the process of storing the inclination angle is not finished in association with every state pattern, the process of this routine is returned to step 41 in which the state pattern is switched to another state pattern, followed by performing the routine from step 42 again.

In accordance with the present embodiment as described above, when it is determined that the intermediate transfer unit is replaced, the control unit 60 resets the inclination angle of the steering roller 9 stored in the memory 61 as set values to the initial value.

By this process, it can be avoided that, even after the intermediate transfer unit is replaced, the memory 61 maintains the information associated with the replaced intermediate transfer unit.

Also, the control unit 60 of the present embodiment refers to the identifier of the IC tag attached to the intermediate transfer unit for the purpose of determining that the intermediate transfer unit is replaced.

By this configuration, the control unit 60 is able to determine by itself when the intermediate transfer unit is replaced.

Furthermore, the control unit 60 of the present embodiment is provided with a mode in which, when it is determined that the intermediate transfer unit is replaced, the updating process is automatically performed after setting the operational states of the rotary members in a predetermined state.

By this configuration, after the intermediate transfer unit is replaced with a new intermediate transfer unit, the information obtained corresponding to the new intermediate transfer unit can automatically be reflected in the memory 61.

Meanwhile, the automatic updating process is performed not only when the intermediate transfer unit is replaced, but also when a user instructs the automatic updating process, when the information stored in the memory 61 is not updated for a long time, and so forth.

In accordance with the present invention as described above, it is possible to store the inclination angle of the steering roller with which the operational state of the intermediate transfer belt is stabilized for each combination of the operational states of the rotary members. While controlling the inclination angle of the steering roller, this appropriate value stored in the storing unit can be reflected in the control. This makes it possible to perform the steering operation in an appropriate manner irrespective of the switching of the operational states of the rotary members in relation to the intermediate transfer belt, and thereby inhibit the image quality from being degraded.

The foregoing description has been presented on the basis of the image forming apparatus according to the present invention. However, it is not intended to limit the present invention to the precise form described, and obviously many modifications and variations are possible within the scope of the invention.

What is claimed is:

1. An image forming apparatus comprising:

an intermediate transfer belt wound around a plurality of rollers including a steering roller;

a rotary member having switchable operational states including a pressure contact state in which the rotary member is in contact with said intermediate transfer belt under pressure, and a separate state in which the rotary member is separated from the intermediate transfer belt;

a detecting unit configured to detect a position of said intermediate transfer belt in a width direction;

a steering control unit configured to perform a steering operation to shift the position of said intermediate transfer belt toward a target belt position by controlling an inclination angle of said steering roller based on a detection result output from said detecting unit;

a timer configured to count a duration for which said steering operation has been performed;

a storing unit configured to store the inclination angle of said steering roller in association with the operational state of said rotary member; and a processing unit configured to determine an update value of the inclination angle of said steering roller, and to perform an updating process to update the inclination angle of said steering roller stored in said storing unit with the update value, wherein when it is determined based on the detection result output from said detecting unit that the position of said intermediate transfer belt falls in a predetermined range around said target belt position during said steering operation, said processing unit determines the update value based on (i) the duration for which said steering operation has been performed counted by the timer, and (ii) the inclination angle of said steering roller controlled by said steering control unit.

2. The image forming apparatus of claim 1, wherein when switching the operational state of said rotary member, said processing unit performs said updating process of updating the inclination angle of said steering roller stored in association with the operational state of said rotary member before the switching.

3. The image forming apparatus of claim 2, wherein said rotary member comprises:

an image bearing member configured to bear an image and transfer the image to said intermediate transfer belt as a first transfer process; and an image transfer member configured to transfer the image from said intermediate transfer belt to a sheet as a second transfer process, wherein said storing unit stores the inclination angle of said steering roller in association with a combination of (i) the operational state of said image bearing member in relation to said intermediate transfer belt, and (ii) the operational state of said image transfer member in relation to said intermediate transfer belt.

4. The image forming apparatus of claim 2, wherein before switching the operational state of said rotary member, said steering control unit controls said steering roller at the inclination angle of said steering roller which has been stored in said storing unit in association with the operational state of said rotary member after the switching.

5. The image forming apparatus of claim 1, wherein said storing unit comprises a nonvolatile memory.

6. The image forming apparatus of claim 5, further comprising an intermediate transfer unit including said intermediate transfer belt, wherein when it is determined that said intermediate transfer unit is replaced, said processing unit resets the inclination angle of said steering roller stored in said storing unit to an initial value.

7. The image forming apparatus of claim 6, wherein said processing unit determines, by referring to an IC tag attached to said intermediate transfer unit, that said intermediate transfer unit is replaced.

8. The image forming apparatus of claim 7, wherein said processing unit is provided with a mode in which, when it is determined that said intermediate transfer unit is replaced, the updating process is automatically performed after setting the operational state of said rotary member in a predetermined state.

9. The image forming apparatus of claim 1, wherein said processing unit is provided with a mode in which the updating process is automatically performed after setting the operational state of said rotary member in a predetermined state.

* * * * *